US012590446B2

(12) United States Patent
Sullivan

(10) Patent No.: US 12,590,446 B2
(45) Date of Patent: Mar. 31, 2026

(54) SINK WITH INTEGRATED DRAIN/WASTE DISPOSAL BRACKET

(71) Applicant: Daniel O. Sullivan, Dayton, KY (US)

(72) Inventor: Daniel O. Sullivan, Dayton, KY (US)

( * ) Notice: Subject to any disclaimer, the term of this patent is extended or adjusted under 35 U.S.C. 154(b) by 85 days.

(21) Appl. No.: 18/761,810

(22) Filed: Jul. 2, 2024

(65) Prior Publication Data

US 2026/0009212 A1 Jan. 8, 2026

(51) Int. Cl.
*E03C 1/182* (2006.01)
*E03C 1/266* (2006.01)

(52) U.S. Cl.
CPC ..... *E03C 1/182* (2013.01); *E03C 1/2665* (2013.01)

(58) Field of Classification Search
CPC ..... E03C 1/182; E03C 1/2665
USPC ... 4/650, 619, 443, 507, 515, 538, 631, 639, 4/643, 663, 665, 671, 675, 679; 454/339; 134/43; 68/3, 232; 108/24; 114/188
See application file for complete search history.

(56) References Cited

U.S. PATENT DOCUMENTS 2,045,969 A * 6/1936 Stanitz ..... E03C 1/18 D23/287
2,055,378 A * 9/1936 Graf ..... E03C 1/18 D23/287
2,127,559 A * 8/1938 Graf ..... E03C 1/18 D23/287
2,157,786 A * 5/1939 Coordes ..... E03C 1/33 4/631
2,282,571 A * 5/1942 Graf ..... B21D 22/26 4/619
2,456,065 A * 12/1948 Just ..... E03C 1/182 D23/284
8,214,934 B2 * 7/2012 Sullivan ..... E03C 1/22 4/287
9,145,666 B2 * 9/2015 Hammer ..... E03C 1/2665
11,149,422 B1 * 10/2021 Just ..... E03C 1/182
11,441,302 B2 * 9/2022 Reidel ..... B02C 23/36
11,549,247 B2 * 1/2023 Just ..... E03C 1/126
11,996,600 B2 * 5/2024 Hollenbeck ..... H01P 3/12
(Continued)

FOREIGN PATENT DOCUMENTS

AU 2017100639 A4 * 7/2017 ..... E03C 1/264
CA 3088404 A1 * 1/2021 ..... E03C 1/2665
(Continued)

*Primary Examiner* — Lori L Baker
(74) *Attorney, Agent, or Firm* — Dorton & Willis LLP; Ryan Willis

(57) ABSTRACT

A sink drain assembly configured to be coupled to at least one of a garbage disposer and a strainer, the sink drain assembly comprising: (i) a sink including a peripheral wall connected to a bottom portion thereof, the bottom portion including a sink opening at least partially delineated by a drain sleeve seamlessly and integrally formed with the bottom portion; and, (ii) a bracket permanently mounted to the drain sleeve and extending away from an underside of the bottom portion of the sink, the bracket including a sealing flange forming a water-tight seal with an outer periphery of the drain sleeve, the bracket including a circumferential wall that delineates a bracket opening larger than the sleeve opening and sink opening, the bracket including at least three helical ramps axially outset from the bracket opening and equidistantly spaced from one another.

16 Claims, 7 Drawing Sheets

(56) References Cited

U.S. PATENT DOCUMENTS

| | | | | |
|---|---|---|---|---|
| 2013/0031719 | A1* | 2/2013 | Ritchel | E03C 1/18 4/650 |
| 2014/0259380 | A1* | 9/2014 | Eilmus | E03C 1/22 4/293 |
| 2016/0208469 | A1* | 7/2016 | Dover | E03C 1/181 |
| 2017/0030058 | A1* | 2/2017 | Lin | E03C 1/22 |
| 2018/0142453 | A1* | 5/2018 | Hocaoglu | E03C 1/335 |
| 2022/0120069 | A1* | 4/2022 | Reidel | B02C 18/0092 |
| 2024/0200316 | A1* | 6/2024 | Leonhard | E03C 1/2665 |
| 2024/0295103 | A1* | 9/2024 | Slothower | E03C 1/264 |

FOREIGN PATENT DOCUMENTS

| | | | | | |
|---|---|---|---|---|---|
| CN | 108005412 | A | * | 5/2018 | A47K 4/00 |
| CN | 118187222 | A | * | 6/2024 | A61L 2/183 |
| CN | 118273426 | A | * | 7/2024 | A47B 77/06 |
| KR | 200391941 | Y1 | * | 8/2005 | E03C 1/182 |
| KR | 200398047 | Y1 | * | 10/2005 | E03C 1/182 |
| KR | 200400606 | Y1 | * | 11/2005 | E03C 1/264 |
| RU | 2695456 | C2 | * | 7/2019 | E03C 1/262 |
| WO | WO-2008091676 | A1 | * | 7/2008 | E03C 1/262 |

* cited by examiner

SINK WITH INTEGRATED DRAIN/WASTE DISPOSAL BRACKET

INTRODUCTION TO THE INVENTION

The present disclosure is directed to sinks with seamless drains and, more specifically, to seamless drain sinks allowing for direct connection to discharge conduits or garbage disposal units using the conventional structures associated with garbage disposal units.

Referring to FIG. 2, typical garbage disposals often comprise of a number of parts that include a lower disposal mounting ring 10 interposing a flanged opening 12 of the disposer and the disposer housing 14, where the disposer housing envelops the working mechanical components of the disposer. This disposal mounting ring 10 typically interfaces with a multi-component sink drain in order to mount the disposal to the sink. By way of example, a multi-component sink drain can include an upper mounting ring 16, a backup flange 18, a gasket 20, a sink flange 22 separable from the sink, a snap ring 24, and a seal 26. But for a seamless drain sink, the separable sink flange 22 is absent. In this fashion, attempting to mount a conventional disposal to a seamless drain sink included unique hardware and modification to the disposal to eliminate the disposal mounting ring 10, as well as mounting instructions that varied from conventional mounts.

U.S. Pat. No. 8,214,934 describes a seamless sink 1 and unique hardware needed to install a disposal. And the reference numerals included herein are the same as those recited in this patent. Specifically, the seamless sink includes a sleeve 3 from which contents of the sink drain. The sleeve 3 includes a peripheral flange 4 that fits within a corresponding groove 7 of a circumferential seal 5, which also has a second circumferential groove 13 to receive the flanged opening 12 of a disposal 8, 9. In order to lock the disposal 8, 9 to the sink 1, a clamp 14 is positioned around the seal 5 and tightened. Similar processes and structures are utilized to couple the sink to a conventional drain pipe that is not intended to receive solid waste. But the drawback to these structures is requiring that any mounting ring of the disposer be removed and having to concurrently hold up the disposer while installing the seal 5 and clamp 14.

It is a first aspect of the present invention to provide a sink drain assembly configured to be coupled to at least one of a garbage disposer and a strainer, the sink drain assembly comprising: (i) a sink including a peripheral wall connected to a bottom portion thereof, the bottom portion including a sink opening at least partially delineated by a drain sleeve seamlessly and integrally formed with the bottom portion; and, (ii) a bracket permanently mounted to the drain sleeve and extending away from an underside of the bottom portion of the sink, the bracket including a sealing flange forming a water-tight seal with an outer periphery of the drain sleeve, the bracket including a circumferential wall that delineates a bracket opening larger than the sleeve opening and sink opening, the bracket including at least three helical ramps axially outset from the bracket opening and equidistantly spaced from one another.

In a more detailed embodiment of the first aspect, the sink opening is in constant fluid communication with the sleeve opening. In yet another more detailed embodiment, the sleeve opening is delineated by a flange, where the size of the sink opening is larger than the size of the sleeve opening. In a further detailed embodiment, the sleeve opening is delineated by a flange, where the flange and the circumferential wall cooperate to define a circumferential cavity circumscribing the sleeve opening. In still a further detailed embodiment, the bracket includes a radial S-shaped cross-section. In a more detailed embodiment, the circumferential wall includes a plurality of cut-outs, with at least one of the cut-outs interposing two of the at least three helical ramps. In a more detailed embodiment, the sink drain assembly further includes a flexible drain ring seal, a drain fitting, and a drain mounting ring, where the drain fitting includes an upper flange having a through opening that transitions into a sleeved conduit that tapers to form a drain pipe adapter configured to engage a drain pipe. In another more detailed embodiment, the drain mounting ring includes: (a) a through opening sized to accommodate throughput of at least a portion of the sleeved conduit, the through opening sized to inhibit throughput of the upper flange; and, (b) a plurality of tabs associated configured to engage the at least three helical ramps to mount the drain mounting ring to the bracket. In yet another more detailed embodiment, the drain mounting ring includes: (a) an inner circumferential wall that at least partially delineates the through opening; and, (b) an outer circumferential wall radially spaced from the inner circumferential wall, the outer circumferential wall having a height less than a height of the inner circumferential wall.

It is a second aspect of the present invention to provide a method of fabricating a sink, the method comprising: (i) obtaining a sink that includes a peripheral wall connected to a bottom portion thereof, the bottom portion including a sink opening at least partially delineated by a drain sleeve seamlessly and integrally formed with the bottom portion; and, (ii) permanently mounting a dual purpose bracket to the drain sleeve to form a water-tight seal therebetween, the dual purpose bracket including a circumferential wall that delincates a bracket opening larger than a sleeve opening, the bracket including at least three helical ramps axially outset from the bracket opening and equidistantly spaced from one another.

In a more detailed embodiment of the second aspect, permanently mounting the dual purpose bracket to the drain sleeve includes using at least one of an adhesive, a weld, and a braze. In yet another more detailed embodiment, the drain sleeve includes a cylindrical portion, and permanently mounting the dual purpose bracket to the drain sleeve includes permanently mounting a ring of the dual purpose bracket to an outside of the cylindrical portion of the drain sleeve. In a further detailed embodiment, obtaining the sink includes the drain sleeve having a lip radially projecting inward from an interior wall of the drain sleeve, and permanently mounting the dual purpose bracket to the drain sleeve includes recessing the lip within a through opening of the dual purpose bracket. In still a further detailed embodiment, permanently mounting the dual purpose bracket to the drain sleeve includes forming a circumferential recess cooperatively formed by the drain sleeve and the circumferential wall. In a more detailed embodiment, the sink opening is larger in cross-sectional area than that of the sleeve opening, a bracket opening of the dual purpose bracket is axially aligned with the sink opening and the sleeve opening, the bracket opening is larger in cross-sectional area than that of the sink opening, and the bracket opening is larger in cross-sectional area that that of the sleeve opening.

It is a third aspect of the present invention to provide a method of mounting a garbage disposal to a sink, the method comprising: (i) repositioning a disposal mounting ring to sandwich a disposal seal between a garbage disposal and a seamless drain sink, the seamless drain sink including a seamless drain, at least partially delineated by a sleeve, and a bracket permanently mounted to the sleeve; and, (ii)

rotating the disposal mounting ring with respect to the seamless drain sink so that a plurality of tabs associated with the disposal mounting ring ride against a plurality of helical ramps associated with the seamless drain sink to complete a fluid-tight seal between the seamless drain sink and the disposal using the disposal seal.

It is a fourth aspect of the present invention to provide a method of mounting a drain to a sink, the method comprising: (i) repositioning a drain mounting ring to sandwich a seal between a drain fitting and a seamless drain sink, the seamless drain sink including a seamless drain, at least partially delineated by a sleeve, and a bracket permanently mounted to a sleeve; and, (ii) rotating the drain mounting ring with respect to the seamless drain sink so that a plurality of tabs associated with the disposal mounting ring ride against a plurality of helical ramps associated with the seamless drain sink to complete a fluid-tight seal between the seamless drain sink and the disposal using the disposal seal.

In a more detailed embodiment of the fourth aspect, rotating the drain mounting ring with respect to the seamless drain sink sandwiches the seal and drain fitting between the seamless drain sink and the drain mounting ring. In yet another more detailed embodiment, rotating the drain mounting ring with respect to the seamless drain sink is operative to push an inner circumferential wall of the drain mounting ring against an underside of a peripheral flange of the drain fitting. In a further detailed embodiment, rotating the drain mounting ring with respect to the seamless drain sink is operative to sandwich the seal between the peripheral flange of the drain fitting and an interior surface of the bracket.

DETAILED DESCRIPTION

The exemplary embodiments of the present disclosure are described and illustrated below to encompass seamless drain sinks with integrated mounting hardware for accepting a conventional disposal's mounting rings or a novel drain mounting system. Of course, it will be apparent to those of ordinary skill in the art that the embodiments discussed below are exemplary in nature and may be reconfigured without departing from the scope and spirit of the present invention. However, for clarity and precision, the exemplary embodiments as discussed below may include optional steps, methods, and features that one of ordinary skill should recognize as not being a requisite to fall within the scope of the present invention.

Figure 1:
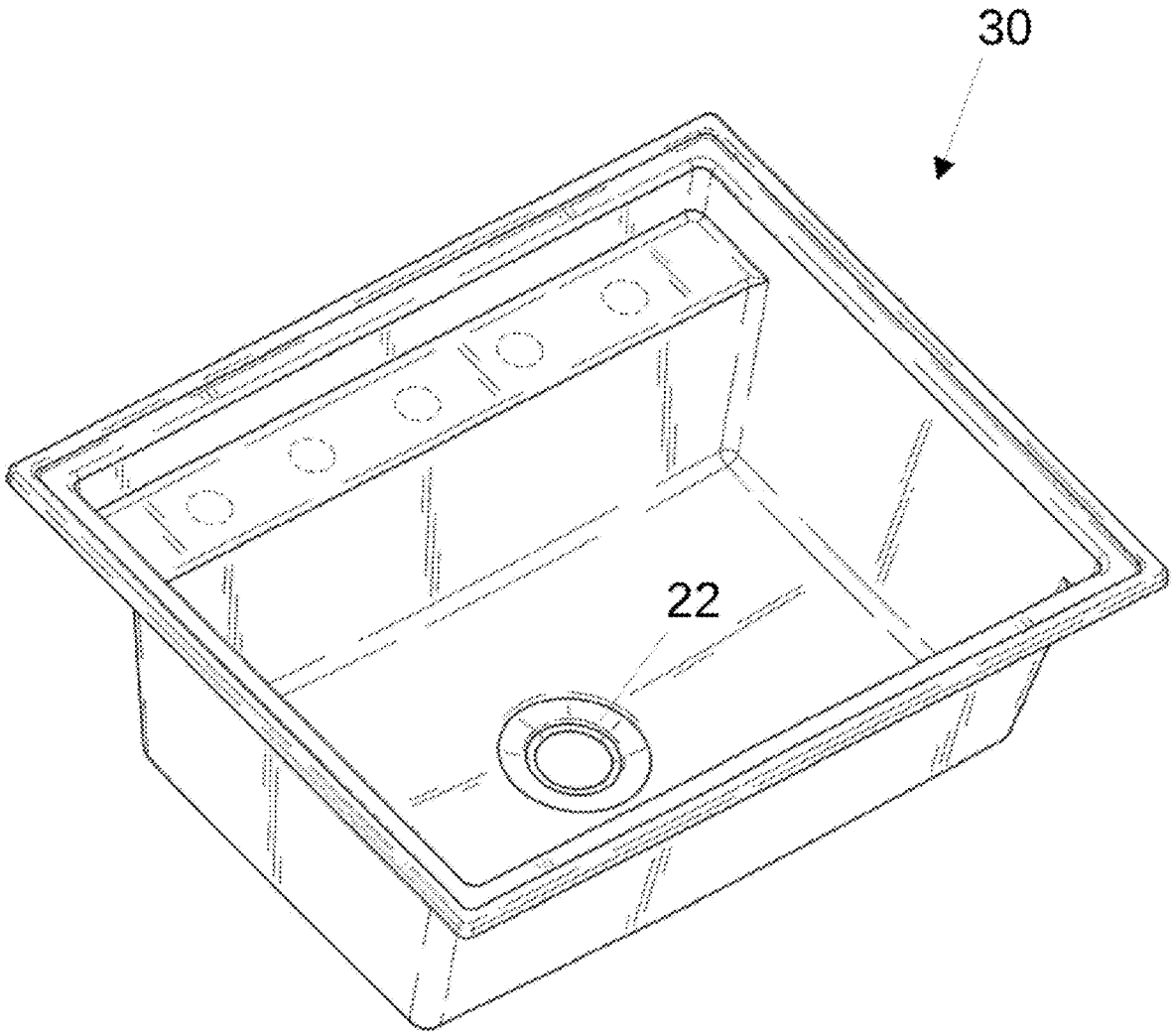
FIG. 1 is an elevated perspective view of a conventional sink with a replaceable sink flange.
Figure 2:
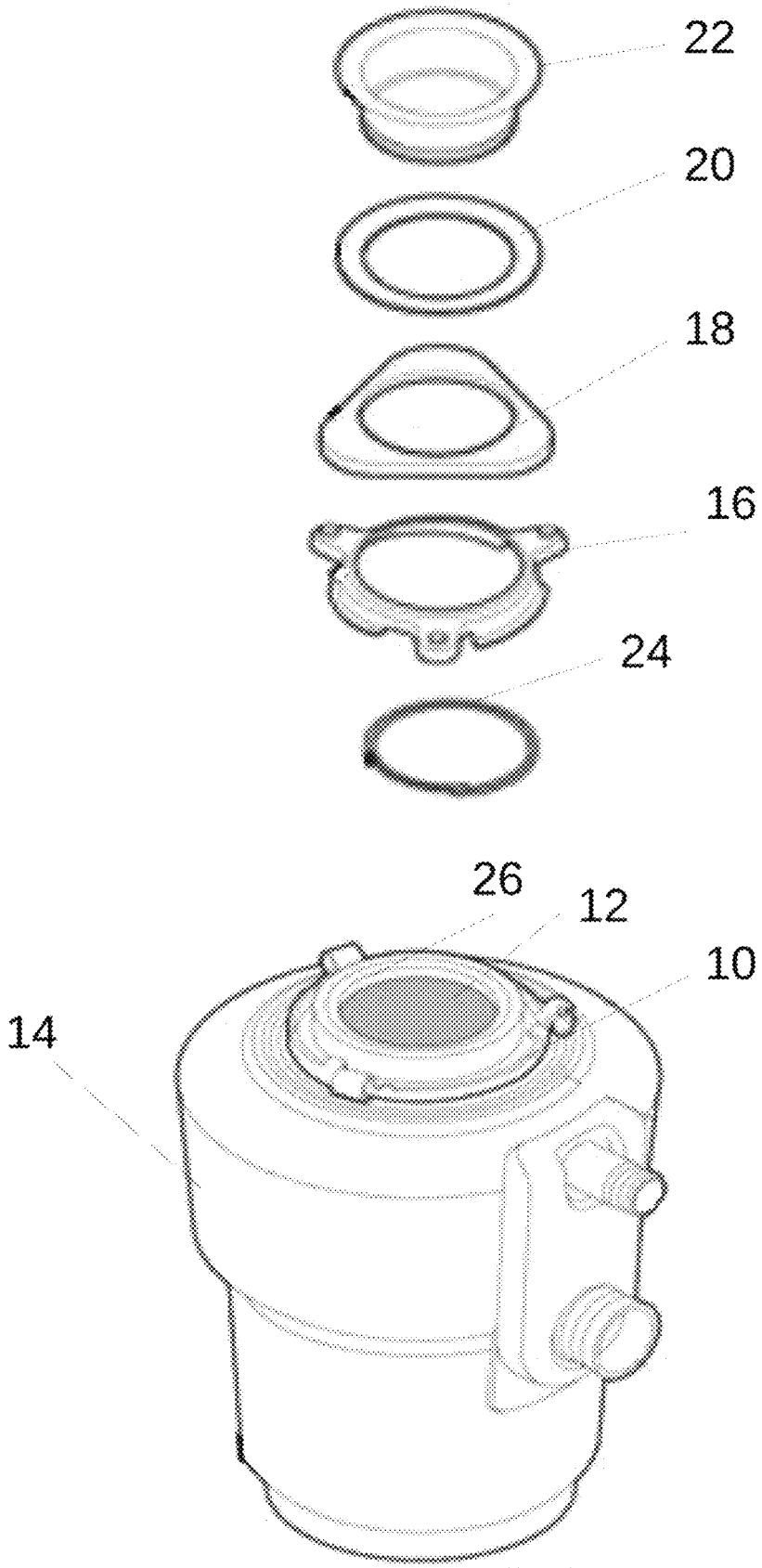
FIG. 2 is an exploded view of a conventional garbage disposal and replaceable fittings used to mount the garbage disposal to a conventional sink.
Figure 3:
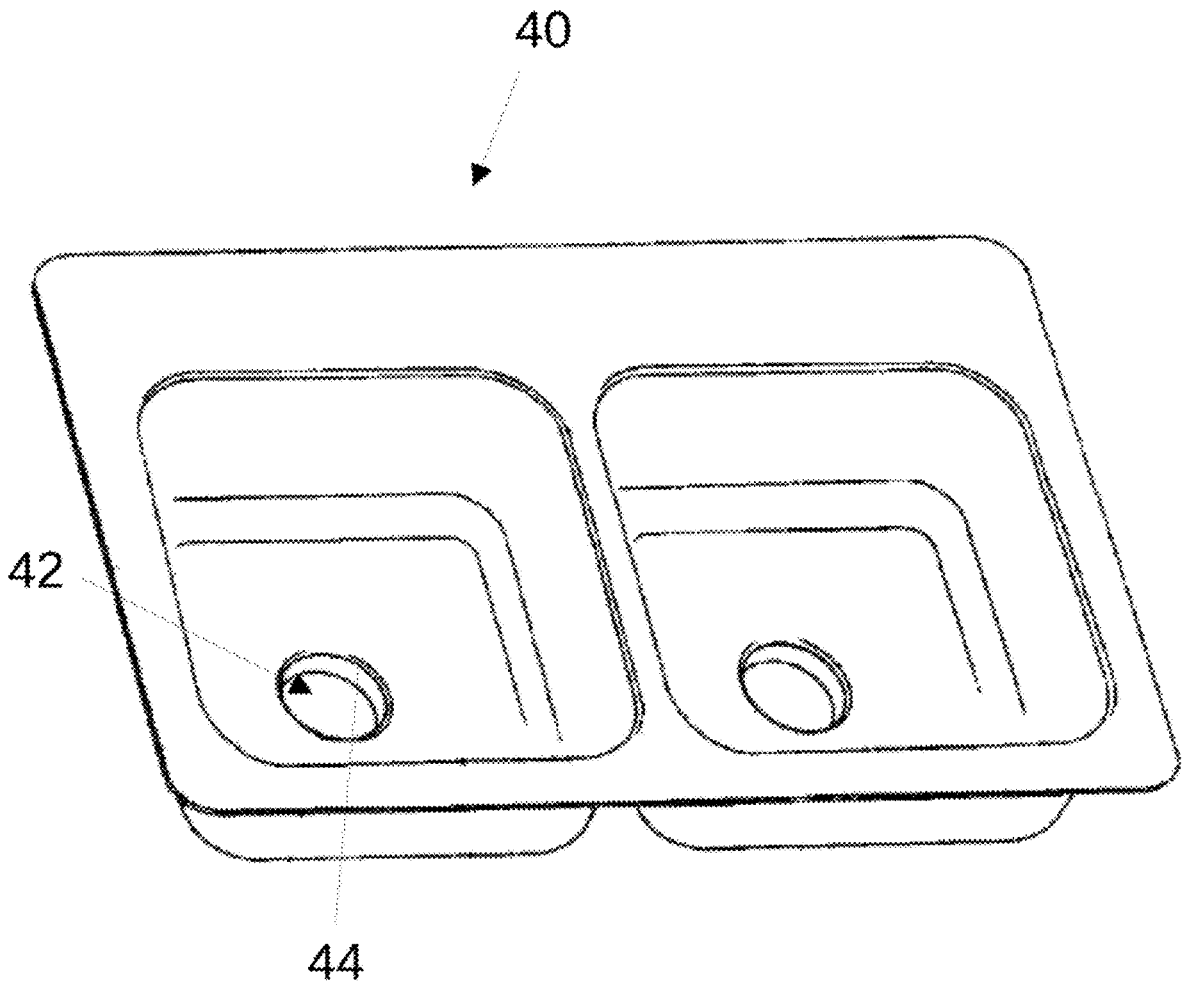
FIG. 3 is an elevated perspective view of a seamless drain sink in accordance with the instant disclosure.

Referencing FIG. 1, a conventional kitchen sink 30 includes a hole punched in the bottom to accept plumbing accessories, namely a removable sink flange 22. In contrast, as depicted in FIG. 3, a first exemplary seamless drain sink 40 is devoid of a removable sink flange and, instead, includes a sink opening 42 delineated by a continuous downward extending sleeve 44. Contents from the sink (liquid and/or solids) flow smoothly through this opening 42 and along the sleeve 44, where the contents are directed into a non-disposer drain 120 (see FIG. 6) or a garbage disposal 14 (see FIG. 9), depending upon how aspects are plumbed downstream from the sleeve. In this manner, the exemplary seamless drain sink 40 may be used with either application without requiring different mounting structures of the sink.

Figure 4:
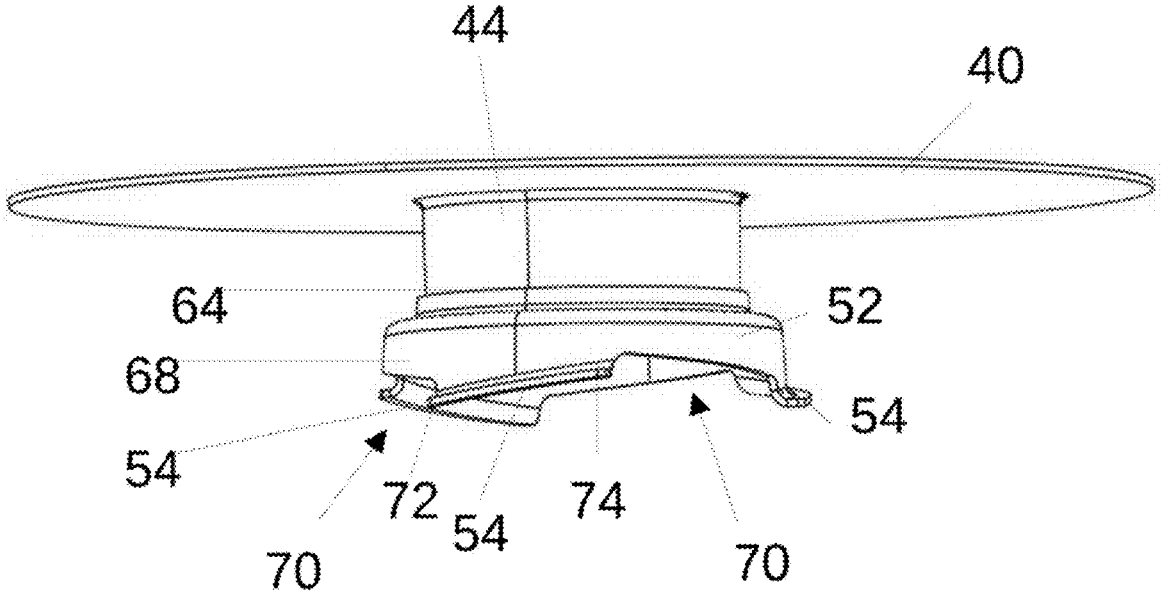
FIG. 4 is an isolated, profile view of a portion of the seamless drain sink of FIG. 3 showing the underside of the seamless drain.
Figure 5:
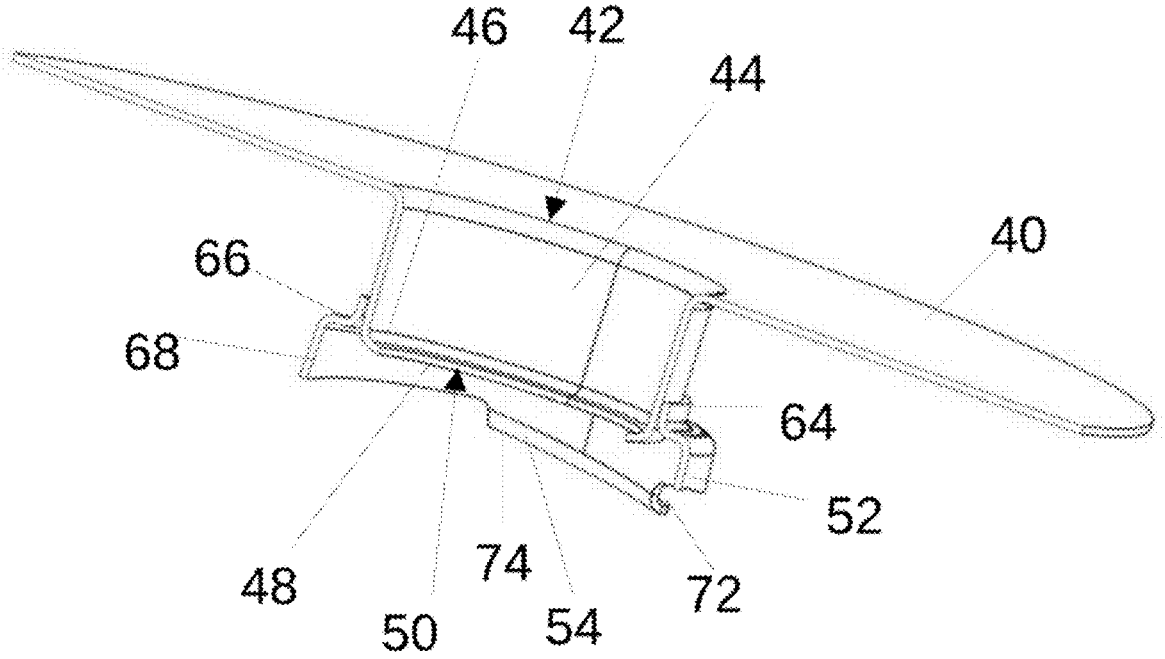
FIG. 5 is an isolated, cross-sectional view of the portion of the seamless drain sink of FIG. 4.

Turning to FIGS. 4 and 5, the first exemplary seamless drain sink 40 includes the downward extending circumferential sleeve 44 transitioning to a rounded edge 46 to form an inner projecting lip 48 slightly narrowing the opening 42. In exemplary form, the inner projecting lip 48 is generally perpendicular to the vertical wall of the sleeve 44 and terminates to define the slightly narrower opening 50.

Extending from the sleeve 44 is a mounting bracket 52 that includes a series of ramps 54 configured to engage corresponding projections 56 of a drain mounting ring 58 to facilitate mounting a liquid drain assembly 80 or a disposal drain assembly 130 to the sink 40. In exemplary form, the mounting bracket 52 includes a first circumferential, vertical sleeve 64 that is slightly larger in diameter than is the sink sleeve 44 so that the first circumferential sleeve 64 can receive the sink sleeve 44 therein. The first circumferential sleeve 64 may be mounted to the sink sleeve 44 using any conventional means including, without limitation, welds, brazing, threaded connection, epoxy, adhesive, and wedges. A bottom of the first circumferential sleeve 64 is rounded and provides a circumferential, horizontal plateau 66 that extends generally perpendicularly away from the first circumferential sleeve to increase the diameter of the bracket 52. The outermost circumference of the plateau 66 is also rounded to transition to a second circumferential, vertical sleeve 68 having a diameter larger than the first sleeve 64. A plurality of cut-outs 70, in exemplary form three, are formed into the second sleeve 68 to create a vertical terminal edge of the sleeve that is vertically lower than the projecting lip 48 of the sink sleeve 44. Interposing the cut-outs 70, are a series of ramps 54, in exemplary form three, formed by rounding the terminal edge of the sleeve 68 to flare outward and increase the diameter of the bracket 52. In particular, each ramp 54 includes a leading edge 72 that is vertically lower with respect to a trailing edge 74. Given the arcuate exterior of the sleeve 68, which the ramps 54 follow, each ramp effectively follows a helical path. Though not depicted, it is also within the scope of the disclosure for the trailing edge 74 of each ramp 54 to include a vertical stop, depression, or detent to preclude a respective projection 56 of the mounting ring 58 from going beyond the trailing edge or a predetermined rotation end.

Figure 6:
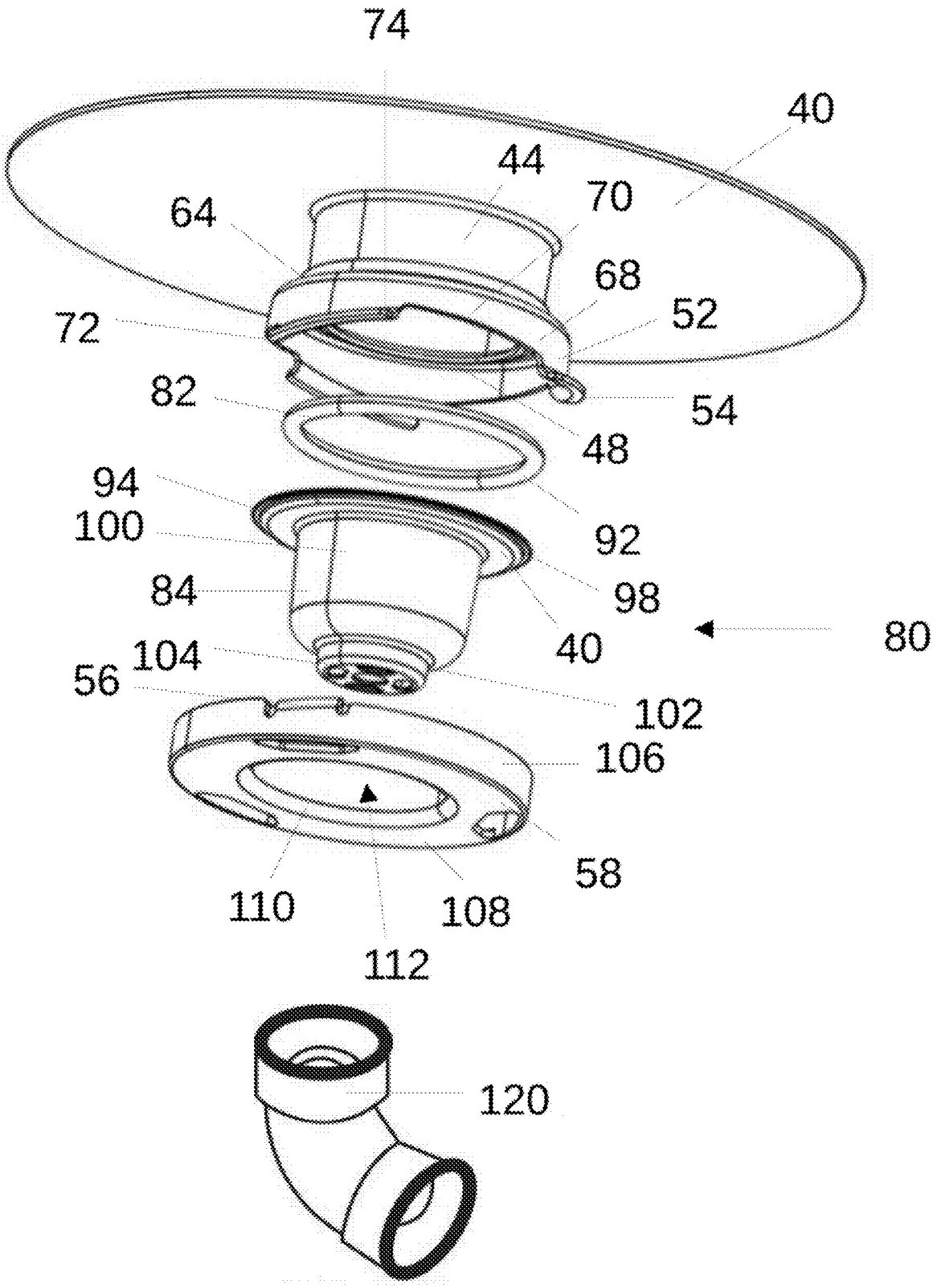
FIG. 6 is a bottom perspective, exploded view of the seamless drain sink portion of FIG. 4 and a liquid drain assembly in accordance with the instant disclosure.
Figure 7:
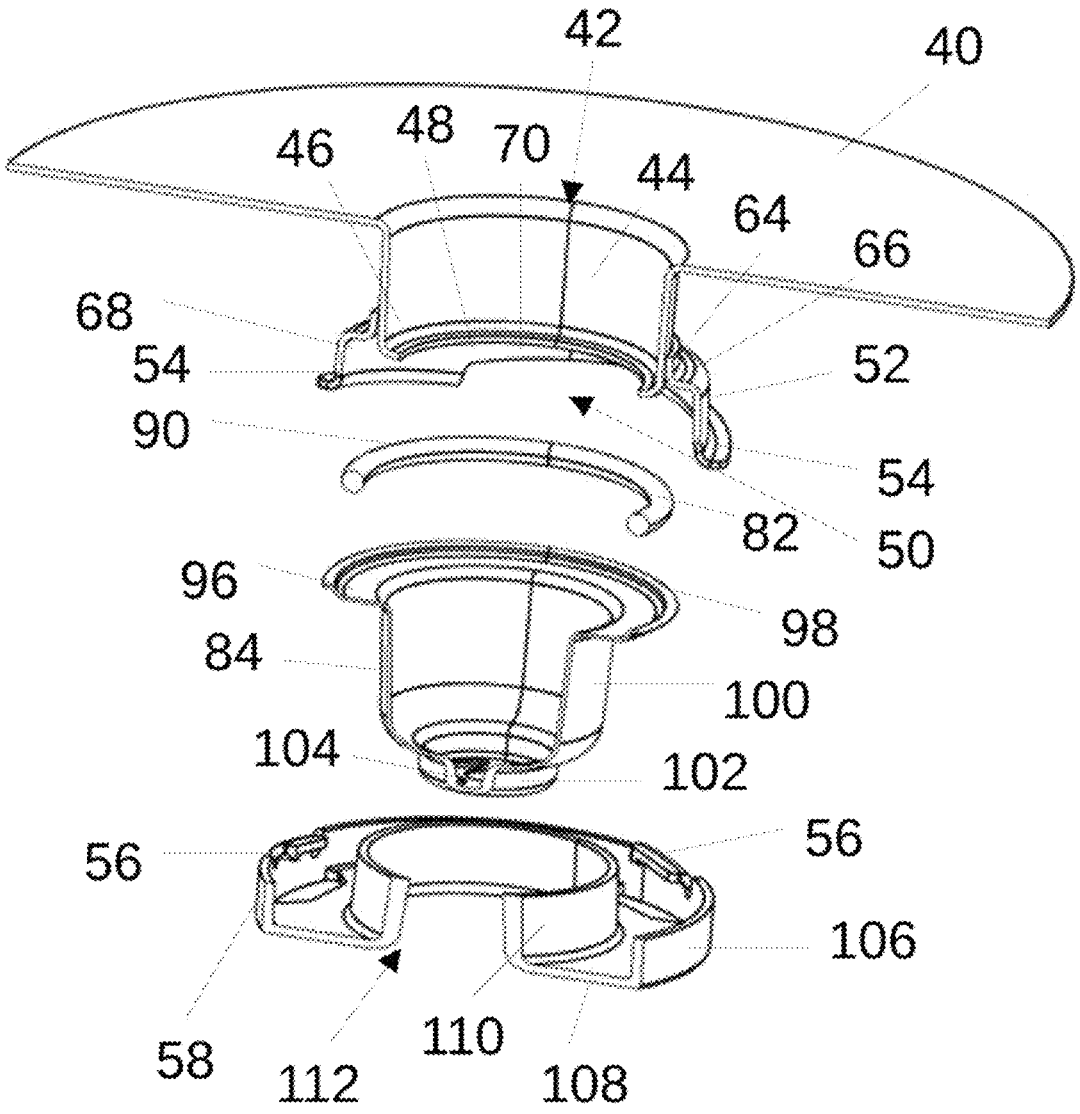
FIG. 7 is a bottom perspective, isolated cross-sectional exploded view of the components of FIG. 6.
Figure 8:
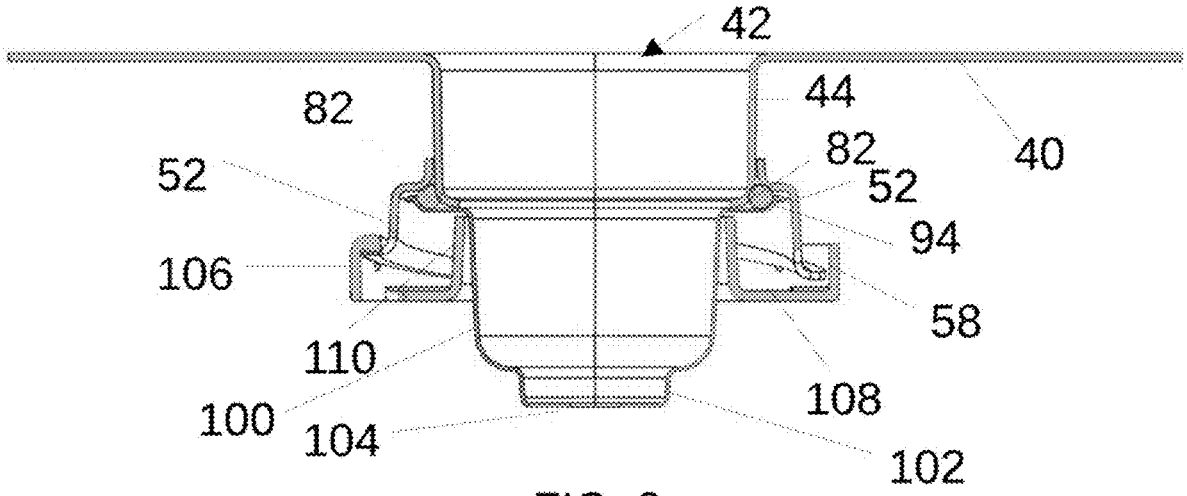
FIG. 8 is a cross-sectional view of the components of FIG. 6.

Referring to FIGS. 6-8, the first exemplary seamless drain sink 40 may be plumbed to accommodate a liquid discharge. In exemplary form, the sink 40 may be mounted to a liquid drain assembly 80 that includes a flexible drain ring seal 82, a drain fitting 84, and a drain mounting ring 58. The interface between the sink 40 and drain assembly 80 ensures that contents flowing through the sink opening 42 are discharged through the drain assembly in a fluid tight manner.

By way of example, the drain seal 82 may comprise a hollow or solid ring having a circular, longitudinal cross-section with opposing top 90 and bottom 92 arcuate surfaces. The inner diameter of the drain seal 82 may be slightly larger than the diameter of the narrower opening 50 and slightly less than the external diameter of the sleeve 44 so that the top arcuate surface 90 concurrently abuts and forms a water-tight seal against an outside of the sleeve 44 or rounded edge 46 when the drain mounting ring 58 is tightened with respect to the bracket 52. Conversely, the bottom arcuate surface 92 of the seal 82 is configured to form a water tight seal against a top annular surface 96 of the drain fitting 84.

In exemplary form, the drain fitting 84 includes a circumferential flange 94 having a raised periphery 98 outset from the top annual surface 96 that may cooperate with the annular surface to provide a seat for the seal 82 to rest upon. In this fashion, the seal 82 may be positioned atop of the annular surface 96 and be retained in position as the drain fitting 84 is vertically repositioned toward the sink 40 as part of installation. In this exemplary embodiment, the outermost diameter of the circumferential flange 94 is less than an inner diameter of the bracket 52, proximate the ramps 54, in order to allow the flange to be inserted into a cavity bound by the vertical sleeve 68. The annular surface 96 of the flange 94 tapers and is rounded over to transition into a funnel 100 that extends vertically downward and eventually further tapers to a circular drain or drain pipe adapter 102, having a drain opening, sized to accept common plumbing conduit such as a drain pipe 120 to further discharge the liquid discharge from the drain fitting 84. The circular drain 102 may include a filter/screen/stainer 104 spanning the drain opening to catch solids of a predetermined size that exit the sink opening 42. As mentioned, in order to mount the drain fitting 84 to the sink 40, by way of the mounting bracket 52, the drain mounting ring 58 is tightened with respect to the bracket.

By way of example, the drain mounting ring 58 includes a circular peripheral wall 106 extending upward from a circular floor 108, where the circular floor includes an inset vertical wall 110 delineating a circular opening 112 through the ring. The diameter of the circular opening 112 is large enough to accommodate throughput to the funnel 100 of the drain fitting 84, but not large enough to allow throughput of the circumferential flange 94 so that, upon installation and tightening of the drain mounting ring 58 against the bracket 52, an underside of the flange sits on top of the inset vertical wall 110. Extending radially inward from the peripheral wall 106, toward the inset vertical wall, are a series of three projections 56. The projections 56 are dimensioned so that the circumferential flange 94 of the drain fitting 84 can pass between all three projections axially, but extend radially inward enough to preclude the bracket 52 from passing axially therebetween except when the cut-outs 70 are vertically/axially aligned with the projections. In other words, the projections 56 are dimensioned so that the ramps 54 cannot pass vertically/axially between the projections. In this manner, when the drain mounting ring 58 is positioned against the bracket 52 so that the projections 56 align with the cut-outs 70 and the ramps 54 are adjacent the circular floor, the drain mounting ring may be rotated clockwise (from the perspective of a bottom view of the drain mounting ring) to cause the projections to ride upon the ramps. Accordingly, after the projections 56 ride upon the ramps 54, continued clockwise motion of the mounting ring 58 causes the drain mounting ring to follow a helical tightening path with respect to the bracket 52. Conversely, counter-clockwise motion of the drain mounting ring 58, when the projections 56 ride upon the ramps 54, causes the drain mounting ring to follow a reverse helical loosening path.

In order to assemble the components depicted in FIGS. 5 and 6, it is not required that the sink 40 be mounted to a countertop or other end location. Nevertheless, the sink 40 is preferably oriented so that the underside is accessible and, more specifically, the underside of the bracket 52 is accessible. In this fashion, the bracket 52 is preferably free of debris and allows for insertion of the seal 82 and drain fitting 84. In particular, the bottom arcuate surface 92 of the seal 82 is configured sit on top of the annular surface 96 of the drain fitting 84 flange 94. The drain mounting ring 58 is then positioned so that the funnel 100, and then the circular drain 102, pass through the circular opening 112 so that an underside of the flange 94 sits on top of the inset vertical wall 110. The liquid drain assembly 80 (including seal 82, drain fitting 84, and drain mounting ring 58) is repositioned so that the top 90 arcuate surface of the seal 82 approximates an outside of the sleeve 44 or rounded edge 46 while the seal remains seated on top of the annual surface 96 of the drain fitting 84 flange 94. Repositioning the liquid drain assembly 80 in this fashion includes moving the drain mounting ring 58 toward the bracket 52 with the projections 56 being aligned with the cut-outs 70 so that continued motion eventually causes the seal 82 to be sandwiched between the drain fitting 84 flange 94 and an outside of the sleeve 44 or rounded edge 46, and the projections are vertically elevated above the leading edge 72 of each ramp 54. At this point, the drain mounting ring 58 may be rotated clockwise (from the bottom perspective of the drain mounting ring 58) so that each projection 56 passes over the leading edge 72 and rides upon a corresponding ramp 54. After the projections 56 are all riding upon a respective ramp 54, continued clockwise rotation will cause the seal 82 to be wedged between the drain fitting 84 flange 94 and an outside of the sleeve 44 or rounded edge 46, resulting in a fluid-tight seal. Eventually, continued clockwise motion of the drain mounting ring 58 will cease as the resistance to further compression of the seal 82 reaches a predetermined point. It should be noted that the ramps 54 may have a corresponding depression or detent into which each projection is received signaling to a user that further clockwise motion of the drain mounting ring 58 is unnecessary because the drain assembly 80 is properly positioned and sealed with respect to the bracket 52 and sink 40.

Figure 9:
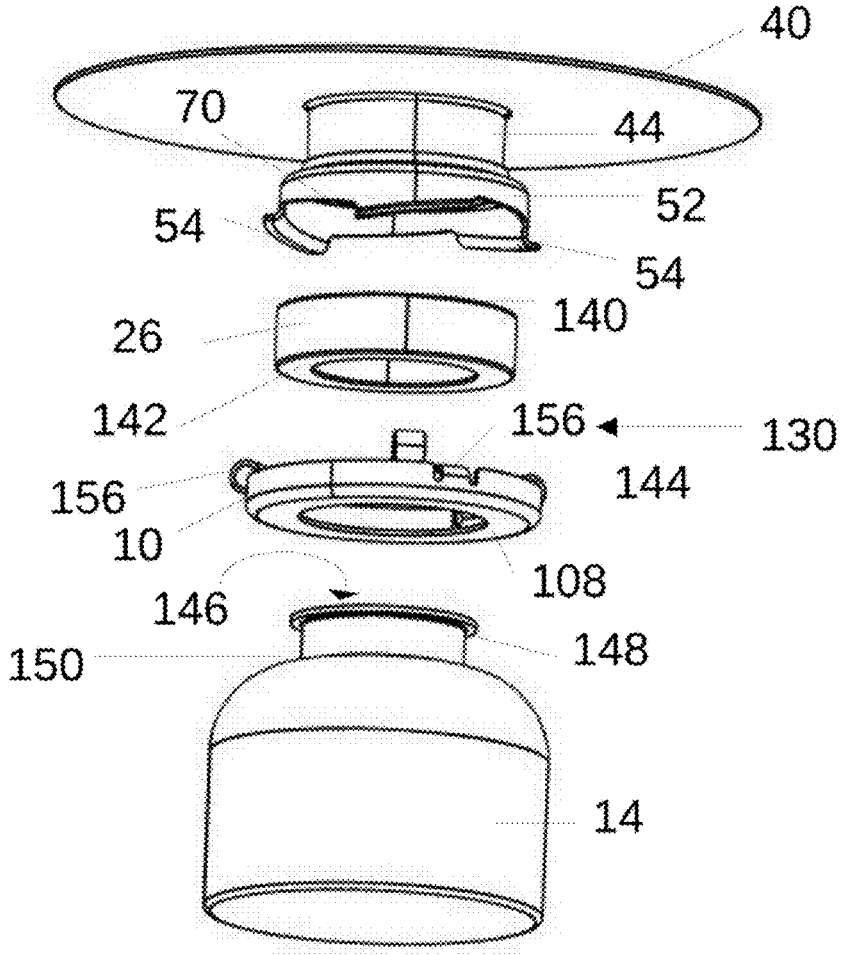
FIG. 9 is a bottom perspective, exploded view of the seamless drain sink portion of FIG. 4 and a drain disposal assembly in accordance with the instant disclosure.

Turning to FIG. 9, the first exemplary seamless drain sink 40 may be plumbed to accommodate a mixture of liquid and solid discharge. In exemplary form, the sink 40 may be mounted to a disposal drain assembly 130 that includes a seal 26, a lower disposal mounting ring 10, and a garbage disposal 14. The interface between the sink 40 and disposal drain assembly 130 ensures that contents flowing through the sink opening 42 are discharged into the garbage disposal 14 in a fluid tight manner.

By way of example, the disposal seal 26 may comprise a hollow, or solid cylinder having a rectangular, longitudinal cross-section with opposing top 140 and bottom 142 planar surfaces. The inner diameter of the disposal seal 26 may be slightly larger than the diameter of the narrower opening 50 so that the top surface 140 abuts and forms a water-tight seal against an outside of the sleeve 44 or rounded edge 46 when the disposal mounting ring 10 is tightened with respect to the bracket 52. Conversely, the bottom surface 142 of the seal 26 is configured to form a water tight seal against the top surface of the disposal mounting flange 148. As a result, contents pass through the sink opening 42 and are able to pass through a central opening 144 of the seal 26 and into an opening 146 at the top of the garbage disposal 14.

In exemplary form, the garbage disposal 14 may be a conventional garbage disposal with a top opening 146 that receives water and solid waste from the sink opening 42 and grinds the contends into a slurry that may be directed out of the disposer via an outlet conduit (not shown). The disposal 14 may include a mounting flange 148 that circumscribes the top opening 146 and provides an attachment used to mount the disposal to the sink via the disposal mounting ring 10. More specifically, the diameter of the mounting flange 148 is greater than a diameter of the opening through the disposal mounting ring 10. In this fashion, when assembled, the disposal mounting ring 10 interposes the mounting flange 148 and a shoulder 150 of the disposal 14. In this fashion, as the disposal mounting ring 10 is raised to contact the underside of the mounting flange, continued upward movement of the disposal mounting ring will correspondingly include corresponding upward movement of the disposal 14.

In order to assemble the components depicted in FIG. 9, it is not required that the sink 40 be mounted to a countertop or other end location. Nevertheless, the sink 40 is preferably oriented so that the underside is accessible and, more specifically, the underside of the bracket 52 is accessible. In this fashion, the bracket 52 is preferably free of debris and allows for insertion of the seal 26 and connection to the lower disposal mounting ring 10. In particular, the bottom surface 142 of the seal 26 is configured sit on the floor 108 of the disposal mounting ring 10. The disposal mounting ring 10 is then repositioned so that the top surface 140 of the seal 26 approximates an outside of the sleeve 44 or rounded edge 46 while the seal remains seated on the floor 108 of the disposal mounting ring. Repositioning the disposal mounting ring 10 in this fashion includes moving the disposal mounting ring and disposal 14 toward the bracket 52 with a series of projections 156 being aligned with the cut-outs 70 so that continued motion eventually causes the seal 26 to be sandwiched between the outside of the sleeve 44 or rounded edge 46 and the floor 108, where the projections are vertically elevated above the leading edge 72 of each ramp 54. At this point, the lower disposal mounting ring 10 may be rotated clockwise (from the bottom perspective of the disposal mounting ring 10) so that each projection 156 passes over the leading edge 72 and rides upon a corresponding ramp 54. After the projections 156 are all riding upon a respective ramp 54, continued clockwise rotation will cause the seal 10 to be wedged between the outside of the sleeve 44 or rounded edge 46 and the floor 108, resulting in a fluid-tight seal. Eventually, continued clockwise motion of the lower mounting ring 10 will cease as the resistance to further compression of the seal 26 reaches a predetermined point. It should be noted that the ramps 54 may have a corresponding depression or detent into which each projection is received signaling to a user that further clockwise motion of the disposal mounting ring 10 is unnecessary because the disposal drain assembly 130 is properly positioned and sealed with respect to the bracket 52 and sink 40.

In certain embodiments, the disposal 14, the seal 26, and the disposal mounting ring 10 may be preinstalled so that the disposal mounting ring 10 may be grasped and repositioned toward the bracket 52 extending downward from the underside of the sink 40. In this fashion, repositioning the disposal mounting ring 10 includes moving the disposal mounting ring, the seal 26, and the disposal 14 together toward the bracket 52 so the series of projections 156 are aligned with the cut-outs 70 on the bracket 52. At this point, the lower disposal mounting ring 10 may be rotated clockwise (from the bottom perspective of the disposal mounting ring 10) so that each projection 156 passes over the leading edge 72 and rides upon a corresponding ramp 54. After the projections 156 are all riding upon a respective ramp 54, continued clockwise rotation will cause the seal 10 to be wedged between the outside of the sleeve 44 or rounded edge 46 and against the upper surface of the mounting flange 148, resulting in a fluid-tight seal. Continued clockwise motion of the lower mounting ring 10 will cease as the resistance to further compression of the seal 26 reaches a predetermined point. It should be noted that the ramps 54 may have a corresponding depression or detent into which each projection is received signaling to a user that further clockwise motion of the disposal mounting ring 10 is unnecessary because the disposal drain assembly 130 is properly positioned and sealed with respect to the bracket 52 and sink 40. In this manner, one can use the components of a commercially available garbage disposal, which comes pre-assembled (seal 26 and disposal mounting ring 10), and mount it directly to the bracket 52 of a seamless drain sink for a quick and easy installation.

Following from the above description, it should be apparent to those of ordinary skill in the art that, while the methods and apparatuses herein described constitute exemplary embodiments of the present invention, the invention described herein is not limited to any precise embodiment and that changes may be made to such embodiments without departing from the scope of the invention as defined by the claims. Additionally, it is to be understood that the invention is defined by the claims and it is not intended that any limitations or elements describing the exemplary embodiments set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any claims, since the invention is defined by the claims and since inherent and/or unforeseen advantages of the present invention may exist even though they may not have been explicitly discussed herein.

What is claimed is:

1. A sink drain assembly configured to be coupled to at least one of a garbage disposer and a strainer, the sink drain assembly comprising:

a sink including a peripheral wall connected to a bottom portion thereof, the bottom portion including a sink opening at least partially delineated by a drain sleeve seamlessly and integrally formed with the bottom portion; and, a bracket permanently mounted to the drain sleeve and extending away from an underside of the bottom portion of the sink, the bracket including a sealing flange forming a water-tight seal with an outer periphery of the drain sleeve, the bracket including a circumferential wall that delineates a bracket opening larger than a sleeve opening and the sink opening, the bracket including at least three helical ramps axially outset from the bracket opening and equidistantly spaced from one another;

wherein the circumferential wall includes a plurality of cut-outs, with at least one of the plurality of cut-outs interposing two of the at least three helical ramps.

2. The sink drain assembly of claim 1, wherein the sink opening is in constant fluid communication with the sleeve opening.

3. The sink drain assembly of claim 1, wherein the sleeve opening is delineated by a flange, where a size of the sink opening is larger than a size of the sleeve opening.

4. The sink drain assembly of claim 1, wherein the sleeve opening is delineated by a flange, where the flange and the circumferential wall cooperate to define a circumferential cavity circumscribing the sleeve opening.

5. The sink drain assembly of claim 1, wherein the bracket includes a radial S-shaped cross-section.

6. A sink drain assembly configured to be coupled to at least one of a garbage disposer and a strainer, the sink drain assembly comprising:

a sink including a peripheral wall connected to a bottom portion thereof, the bottom portion including a sink opening at least partially delineated by a drain sleeve seamlessly and integrally formed with the bottom portion;

a bracket permanently mounted to the drain sleeve and extending away from an underside of the bottom portion of the sink, the bracket including a sealing flange forming a water-tight seal with an outer periphery of the drain sleeve, the bracket including a circumferential wall that delineates a bracket opening larger than a sleeve opening and the sink opening, the bracket including at least three helical ramps axially outset from the bracket opening and equidistantly spaced from one another; and, a flexible drain ring seal, a drain fitting, and a drain mounting ring, where the drain fitting includes an upper flange having a through opening that transitions into a sleeved conduit that tapers to form a drain pipe adapter configured to engage a drain pipe.

7. The sink drain assembly of claim 6, wherein the drain mounting ring includes:

a through opening sized to accommodate throughput of at least a portion of the sleeved conduit, the through opening sized to inhibit throughput of the upper flange; and, a plurality of tabs configured to engage the at least three helical ramps to mount the drain mounting ring to the bracket.

8. The sink drain assembly of claim 6, wherein the drain mounting ring includes:

an inner circumferential wall that at least partially delineates the through opening; and, an outer circumferential wall radially spaced from the inner circumferential wall, the outer circumferential wall having a height less than a height of the inner circumferential wall.

9. A method of fabricating a sink, the method comprising the steps of:

obtaining a sink that includes a peripheral wall connected to a bottom portion thereof, the bottom portion including a sink opening at least partially delineated by a drain sleeve seamlessly and integrally formed with the bottom portion; and, permanently mounting a bracket to the drain sleeve to form a water-tight seal therebetween, the bracket including a circumferential wall that delineates a bracket opening larger than a sleeve opening, the bracket including at least three helical ramps axially outset from the bracket opening and equidistantly spaced from one another;

wherein the drain sleeve includes a cylindrical portion; and, wherein permanently mounting the bracket to the drain sleeve includes permanently mounting a ring of the bracket to an outside of the cylindrical portion of the drain sleeve.

10. The method of claim 9, wherein permanently mounting the bracket to the drain sleeve includes using at least one of an adhesive, a weld, and a braze.

11. The method of claim 9, wherein:

obtaining the sink includes the drain sleeve having a lip radially projecting inward from an interior wall of the drain sleeve; and, permanently mounting the bracket to the drain sleeve includes recessing the lip within a through opening of the bracket.

12. The method of claim 11, wherein permanently mounting the bracket to the drain sleeve includes forming a circumferential recess cooperatively by the drain sleeve and the circumferential wall.

13. The method of claim 9, wherein:

the sink opening is larger in cross-sectional area than that of the sleeve opening;

the bracket opening of the bracket is axially aligned with the sink opening and the sleeve opening;

the bracket opening is larger in cross-sectional area than that of the sink opening; and, the bracket opening is larger in cross-sectional area that that of the sleeve opening.

14. A method of mounting a drain to a sink, the method comprising the steps of:

repositioning a drain mounting ring to sandwich a seal between a drain fitting and a seamless drain sink, the seamless drain sink including a seamless drain, at least partially delineated by a sleeve, and a bracket permanently mounted to the sleeve; and, rotating the drain mounting ring with respect to the seamless drain sink so that a plurality of tabs associated with the drain mounting ring ride against a plurality of helical ramps associated with the seamless drain sink to complete a fluid-tight seal between the seamless drain sink and the drain fitting using the seal;

wherein rotating the drain mounting ring with respect to the seamless drain sink sandwiches the seal and the drain fitting between the seamless drain sink and the drain mounting ring.

15. A method of mounting a drain to a sink, the method comprising the steps of:

repositioning a drain mounting ring to sandwich a seal between a drain fitting and a seamless drain sink, the seamless drain sink including a seamless drain, at least partially delineated by a sleeve, and a bracket permanently mounted to the sleeve; and, rotating the drain mounting ring with respect to the seamless drain sink so that a plurality of tabs associated with the drain mounting ring ride against a plurality of helical ramps associated with the seamless drain sink to complete a fluid-tight seal between the seamless drain sink and the drain fitting using the seal;

wherein rotating the drain mounting ring with respect to the seamless drain sink is operative to push an inner circumferential wall of the drain mounting ring against an underside of a peripheral flange of the drain fitting.

16. The method of claim 15, wherein rotating the drain mounting ring with respect to the seamless drain sink is operative to sandwich the seal between the peripheral flange of the drain fitting and an interior surface of the bracket.

* * * * *